US007976582B2

(12) United States Patent
de Almeida et al.

(10) Patent No.: US 7,976,582 B2
(45) Date of Patent: Jul. 12, 2011

(54) BLEACHING OF SUBSTRATES

(75) Inventors: Joaquim Manuel Henriques de Almeida, Matlock (GB); Herbert Bachus, Hechingen (DE); Zinaida Ponie Djodikromo, Rotterdam (NL); Christian Doerfler, Kusterdingen (DE); Ronald Hage, Vlaardingen (NL); Joachim Lienke, Vlaardingen (NL)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 12/523,057

(22) PCT Filed: Dec. 20, 2007

(86) PCT No.: PCT/EP2007/064334

§ 371 (c)(1),
(2), (4) Date: Jul. 14, 2009

(87) PCT Pub. No.: WO2008/086937

PCT Pub. Date: Jul. 24, 2008

(65) Prior Publication Data

US 2010/0101029 A1 Apr. 29, 2010

(30) Foreign Application Priority Data

Jan. 16, 2007 (EP) ..... 07100578

(51) Int. Cl.

| | |
|---|---|
| ***D06L 3/02*** | (2006.01) |
| ***C11D 3/26*** | (2006.01) |
| ***C11D 3/39*** | (2006.01) |
| ***C11D 3/395*** | (2006.01) |

(52) U.S. Cl. ..... 8/111; 510/303; 510/311; 510/336; 510/337; 510/372; 510/376; 510/499; 510/505; 510/509; 252/186.27; 252/186.33

(58) Field of Classification Search ..... 510/303, 510/311, 336, 337, 372, 376, 499, 505, 509; 8/111, 137; 252/186.27, 186.33
See application file for complete search history.

(56) References Cited

U.S. PATENT DOCUMENTS

| | | | | |
|---|---|---|---|---|
| 5,329,024 | A | 7/1994 | Jureller et al. | |
| 5,356,554 | A | 10/1994 | Delwel et al. | |
| 5,429,769 | A * | 7/1995 | Nicholson et al. | 510/376 |
| 5,516,738 | A | 5/1996 | Jureller et al. | |
| 6,087,312 | A * | 7/2000 | Masotti et al. | 510/309 |
| 2001/0025695 | A1 | 10/2001 | Patt et al. | |
| 2002/0010120 | A1 | 1/2002 | Hage et al. | |
| 2002/0066542 | A1 | 6/2002 | Jakob et al. | |
| 2003/0040459 | A1 * | 2/2003 | Araya et al. | 510/446 |
| 2005/0137105 | A1 * | 6/2005 | Griese et al. | 510/220 |
| 2005/0137118 | A1 * | 6/2005 | Silveri | 510/514 |

FOREIGN PATENT DOCUMENTS

| | | |
|---|---|---|
| EP | 0 458 397 | 5/1991 |
| EP | 0458398 | 5/1991 |
| EP | 0509878 | 4/1992 |
| EP | 0530870 | 7/1992 |
| EP | 0544490 | 11/1992 |
| WO | WO 95/27773 | 10/1995 |
| WO | WO 97/44520 | 11/1997 |
| WO | WO 01/64993 | 9/2001 |
| WO | 02/064721 A | 8/2002 |
| WO | WO 02/088063 | 11/2002 |
| WO | 2006/125517 | 11/2006 |
| WO | WO2007042192 * | 4/2007 |

OTHER PUBLICATIONS

International Search Report, PCT/EP2007/064334, mailed Nov. 4, 2008, 3 pp.
EP Examination Report in EP Patent Application No. 07 857 954.7, Feb. 1, 2010.
Hage et al., "Efficient Manganese Catalysts for Low-Temperature Bleaching", Nature, Jun. 23, 1994, vol. 369, pp. 637-639.

* cited by examiner

*Primary Examiner* — Gregory R Del Cotto
(74) *Attorney, Agent, or Firm* — Knobbe, Martens, Olson & Bear, LLP

(57) ABSTRACT

The present invention concerns the treatment of a cellulose material in the presence of a transition metal catalyst, hydrogen peroxide whilst maintaining the pH of the treatment mixture.

14 Claims, No Drawings

BLEACHING OF SUBSTRATES

FIELD OF INVENTION

The present invention relates to the catalytic bleaching of substrates.

BACKGROUND OF INVENTION

The bleaching of raw cotton and wood pulp are massive industries.

Raw cotton originating from cotton seeds contains mainly colourless cellulose, but has a yellow-brownish colour due to the natural pigment in the plant. Many impurities adhere, especially to the surface. They consist mainly of protein, pectin, ash and wax.

The cotton and textile industries recognise a need for bleaching cotton prior to its use in textiles and other areas. The cotton fibres are bleached to remove natural and adventitious impurities with the concurrent production of substantially whiter material.

There have been two major types of bleach used in the cotton industry. One type is a dilute alkali or alkaline earth metal hypochlorite solution. The most common types of such hypochlorite solutions are sodium hypochlorite and calcium hypochlorite. Additionally, chlorine dioxide as bleaching agent has been developed and shows less cotton damage than hypochlorite does. Also mixtures of chlorine dioxide and hypochlorite can be applied. The second type of bleach is a peroxide solution, e.g., hydrogen peroxide solutions. This bleaching process is typically applied at high temperatures, i.e. 80 to 100° C. Controlling the peroxide decomposition due to trace metals is key to successfully apply hydrogen peroxide. Often Mg-silicates or sequestering agents such as EDTA or analogous phosphonates can be applied to reduce decomposition.

The above types of bleaching solutions and caustic scouring solutions may cause tendering of the cotton fibre due to oxidation which occurs in the presence of hot alkali or from the uncontrolled action of hypochlorite solutions during the bleaching process. Also hydrogen peroxide is known to give reduced cotton fibre strengths, especially when applied without proper sequestration or stabilisation of transition-metal ions. Tendering can also occur during acid scours by the attack of the acid on the cotton fibre with the formation of hydrocellulose.

Purified cellulose for rayon production usually comes from specially processed wood pulp. It is sometimes referred to as "dissolving cellulose" or "dissolving pulp" to distinguish it from lower grade pulps used for papermaking and other purposes. Dissolving cellulose is characterised by a high cellulose content, i.e., it is composed of long-chain molecules, relatively free from lignin and hemicelluloses, or other short-chain carbohydrates. A manufactured fibre composed of regenerated cellulose, in which substituents have replaced not more than 15% of the hydrogens of the hydroxyl groups.

Wood pulp produced for paper manufacture either contains most of the originally present lignin and is then called mechanical pulp or it has been chiefly delignified, as in chemical pulp. Different sources of wood pulp can be found, such as softwood pulp (from e.g., fir trees), or hardwood pulp, such as that originating from birch or eucalyptus trees. Mechanical pulp is used for e.g. newsprint and is often more yellow than paper produced from chemical pulp (such as for copy paper or book-print paper). Further, paper produced from mechanical pulp is prone to yellowing due to light- or temperature-induced oxidation. Whilst for mechanical pulp production mild bleaching processes are applied, to produce chemical pulp having a high whiteness, various bleaching and delignification processes are applied. Widely applied bleaches include elemental chlorine, chlorine dioxide, hydrogen peroxide, and ozone.

Whilst for both textile bleaching and wood pulp bleaching, chlorine-based bleaches are often most effective, there is a need to apply oxygen-based bleaches for environmental reasons. Hydrogen peroxide is a good bleaching agent; however, it needs to be applied at high temperatures and long reaction times. For industry it is desirable to be able to apply hydrogen peroxide at lower temperatures and shorter reaction times than in current processes.

The macrocyclic triazacyclic molecules have been known for several decades, and their complexation chemistry with a large variety of metal ions has been studied thoroughly. The azacyclic molecules often lead to complexes with enhanced thermodynamic and kinetic stability with respect to metal ion dissociation, compared to their open-chain analogues.

EP 0458397 discloses the use manganese 1,4,7-Trimethyl-1,4,7-triazacyclononane ($Me_3$-TACN) complexes as bleaching and oxidation catalysts and use for paper/pulp bleaching and textile bleaching processes. 1,4,7-Trimethyl-1,4,7-triazacyclononane ($Me_3$-TACN) has been used in dishwashing for automatic dishwashers, SUN™, and has also been used in a laundry detergent composition, OMO Power™. The ligand ($Me_3$-TACN) is used in the form of its manganese transition metal complex, the complex having a counter ion that prevents deliquescence of the complex.

United States Application 2001/0025695A1, Patt et al, discloses the use of $PF_6^-$ salts of 1,2,-bis-(4,7,-dimethyl-1,4,7,-triazacyclonon-1-yl)-ethane and $Me_3$-TACN (Me4-DTNE).

United States Application 2002/010120 discloses the bleaching of substrates in an aqueous medium, the aqueous medium comprising a transition metal catalyst and hydrogen peroxide.

WO 2006/125517 discloses a method of catalytically treating a cellulose or starch substrate with a Mn(III) or Mn(IV) preformed transition metal catalyst salt and hydrogen peroxide in an aqueous solution. The preformed transition metal catalyst salt is described as having a non-coordinating counter ion and having a water solubility of at least 30 g/l at 20° C. Exemplified ligands of the catalysts described in WO 2006/125517 are 1,4,7-Trimethyl-1,4,7-triazacyclononane ($Me_3$-TACN) and 1,2,-bis-(4,7,-dimethyl-1,4,7,-triazacyclonon-1-yl)-ethane ($Me_4$-DTNE).

SUMMARY OF INVENTION

The present invention provides effective bleaching of cellulose material whilst reducing cellulosic polymer degradation which results in fiber damage.

In one aspect the present invention provides a method of bleaching a cellulose material comprising the following step: treating the cellulose material with an non-buffered aqueous solution, the aqueous solution having a initial pH from 8 to 11, the aqueous solution comprising:

(i) a preformed transition metal catalyst (manganese catalyst), the transition metal catalyst present in a concentration from 0.1 to 100 micromolar, and (ii) from 5 to 1500 mM of hydrogen peroxide, wherein the pH of the aqueous solution is maintained within an operating window such that the initial pH does not decrease by more than 1.5 pH units during the treatment of the cellulose material in the presence of the catalyst before rinsing and, the preformed transition metal catalyst is a mononuclear or dinuclear complex of a Mn(III) or Mn(IV) transition metal catalyst wherein the ligand of the transition metal catalyst is of formula (I):

(I)

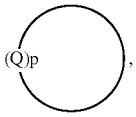

wherein: Q = —N(R)—[$CR_1R_2CR_3R_4$)—;

p is 3;

R is independently selected from: hydrogen, C1-C6-alkyl, CH2CH2OH, and CH2COOH, or one of R is linked to the N of another Q via an ethylene bridge;

R1, R2, R3, and R4 are independently selected from: H, C1-C4-alkyl, and C1-C4-alkylhydroxy, wherein the pH of the aqueous solution is maintained within the operating window of 1.5 pH units by a process selected from:

a) the cellulose material is first treated with NaOH and at pH from 11 to 12 for between 2 and 120 min at a temperature in the range from 50 to 110° C. without the presence of the manganese catalyst, after which the pH is lowered to the pH range from 9 to 11 and further treated in the presence of the manganese catalyst for between 2 and 60 min at 50 to 110° C., hydrogen peroxide being added either during with the first treatment with NaOH and/or when the manganese catalyst is present;

b) the cellulose material is treated at a pH in the range from 10 to 11 with sequestrant, $H_2O_2$, NaOH and the manganese catalyst whilst permitting the pH to reduce naturally as a consequence of the bleaching; and, c) the cellulose material is treated with sequestrant, $H_2O_2$, NaOH and the manganese catalyst whilst maintaining the pH in the range 8 to 11 by addition of aqueous NaOH.

Of the steps a), b) and c) step b) is the most preferred and step a) is the second most preferred.

DETAILED DESCRIPTION OF INVENTION

Maintenance of pH

Stabilization of the pH provides better bleaching of the cellulosic material. The requirement that the pH of the aqueous solution is prevented from decreasing by more than 1.5 pH unit during treatment of the cellulose material in the presence of the catalyst before rinsing may be provided for in a number of ways. Below are three ways that are preferred.

First High pH with H2O2 and Surfactant without Catalyst, then Dropping the pH and Add Catalyst 1) Pretreating the cellulose material with base (e.g., NaOH) to ca pH 11.5 and optionally with $H_2O_2$ before lowering the pH to the range 8 to 11 and then adding the manganese catalyst. If no $H_2O_2$ was used in the pretreatment stage then $H_2O_2$ must be added after or as the pH is lowered. Optionally, also low amounts of hydrogen peroxide may be employed in the pretreatment phase, and additional hydrogen peroxide may be added after or as the pH is lowered. There is no need rinse or wash the cellulose material after the pretreatment step, although an aqueous wash is preferred but this adds to cost.

Single Stage Process, Starting at the Appropriate pH Window.

2) Commencing treatment of the cellulose material at pH in the range from 10 to 11 with sequestrant/$H_2O_2$/NaOH/manganese catalyst and letting the pH reduce naturally as a consequence of the bleaching (typically from pH 8.5 to 10).

Single Stage Process at Lower pH with Maintaining the pH Constant.

3) Maintaining the pH in the range 8 to 11 during the treatment by addition, preferably continuous, of aqueous NaOH. This may be provided by the use of a pH probe together with a feed back loop which controls the addition of sodium hydroxide.

Other ways of maintaining the pH in the range 8 to 11 during the treatment such as by applying ion exchange resins may be used.

Ideally the pH is constant and is prevented from decreasing during treatment of the cellulose material in the presence of the manganese catalyst before rinsing. However practically this is difficult to effect but in reality the pH change can be minimized to a pH change of 0.2 in an industrial setting.

Preferably, the pH of the aqueous solution is prevented from decreasing by more than 1 pH unit during treatment of the cellulose material in the presence of the manganese catalyst before rinsing, more preferably 0.7 pH, even more preferably 0.4 pH.

One will appreciate the closer the pH tolerances the greater the cost of treatment.

Cellulose Material

This may be found, for example, cotton, wood pulp, straw, and hemp. Preferably the cellulose material treated is wood pulp or cotton, most preferably cotton.

Raw cotton (gin output) is dark brown in colour due to the natural pigment in the plant. The cotton and textile industries recognise a need for bleaching cotton prior to its use in textiles and other areas. The object of bleaching such cotton fibres is to remove natural and adventitious impurities with the concurrent production of substantially whiter material.

Wood pulp produced for paper manufacture either contains most of the originally present lignin and is then called mechanical pulp or it has been chiefly delignified, as in chemical pulp. Different sources of wood pulp can be found, such as softwood pulp, e.g., from fir trees, or hardwood pulp, e.g., from birch or eucalyptus trees. Mechanical pulp is used for newsprint and is often more yellow than paper produced from chemical pulp. Further, paper produced from mechanical pulp is prone to yellowing due to light- or temperature-induced oxidation. Whilst for mechanical pulp production mild bleaching processes are applied, to produce chemical pulp having a high whiteness, various bleaching and delignification processes are applied.

Widely applied bleaches include elemental chlorine, hydrogen peroxide, chlorine dioxide and ozone.

The aforementioned materials are discussed in WO 2006/125517.

The method is also applicable to laundry applications in both domestic and industrial settings. The method is particularly applicable to domestic or industrial laundering machines that have capabilities to control the pH during the washing processes, such as described in US2006/0054193, US2005-0252255, and US2005-0224339. The method is most particularly applicable to the bleaching of stains found on white institutional cotton fabric as found in prisons and hospitals.

Non-Buffered System

The aqueous solution is not buffered. In this regard, the aqueous solution does not contain an inorganic buffer, e.g., carbonate, phosphate, and borate. However, the organic sequestrant and hydrogen peroxide may be considered to have some buffering capacity but this is not to be considered as buffering within the context of the present invention. Most preferably, the aqueous solution is not buffered other than by the organic sequestrant and hydrogen peroxide.

Transition Metal Catalyst

EP 0458397 and EP 0458398 disclose the use manganese 1,4,7-Trimethyl-1,4,7-triazacyclononane ($Me_3$-TACN) complexes as bleaching and oxidation catalysts and use for paper/pulp bleaching and textile bleaching processes. 1,4,7-Trimethyl-1,4,7-triazacyclononane ($Me_3$-TACN) has been used in dishwashing for automatic dishwashers, SUN™, and has also been used in a laundry detergent composition, OMO Power™. The ligand ($Me_3$-TACN) is used in the form of its manganese transition metal complex, the complex having a counter ion that prevents deliquescence of the complex. The counter ion for the commercialised products containing manganese $Me_3$-TACN is $PF_6^-$. The is $Me_3$-TACN $PF_6^-$ salt has a water solubility of 10.8 g per liter at 20° C. Additionally, the perchlorate ($ClO_4^-$) counter ion is acceptable from this point of view because of its ability to provide a manganese $Me_3$-TACN that does not appreciably absorb water. However, due to potential explosive properties of transition-metal perchlorate complexes, perchlorate-containing compounds are not preferred. Reference is made to U.S. Pat. No. 5,256,779 and EP 458397, both of which are in the name of Unilever. One advantage of the $PF_6^-$ or $ClO_4^-$ counter ions for the manganese $Me_3$-TACN complex is that the complex may be easily purified by crystallisation and recrystallisation from water. In addition, there non-deliquescent salts permit processing, e.g., milling of the crystals, and storage of a product containing the manganese $Me_3$-TACN. Further, these anions provide for storage-stable metal complexes. For ease of synthesis of manganese $Me_3$-TACN highly deliquescent water soluble counter ions are used, but these counter ions are replaced with non-deliquescent, much less water soluble counter ions at the end of the synthesis. During this exchange of counter ion and purification by crystallisation loss of product results. A drawback of using $PF_6^-$ as a counterion is its significant higher cost when compared to other highly soluble anions.

Whilst the manganese transition metal catalyst used may be non-deliquescent by using counter ions such as $PF_6^-$ or $ClO_4^-$, it is preferred for industrial substrates that the transition metal complex is water soluble. It is preferred that the preformed transition metal is in the form of a salt such that it has a water solubility of at least 50 g/l at 20° C. Preferred salts are those of chloride, acetate, sulphate, and nitrate. These salts are described in WO 2006/125517.

The preformed transition metal catalyst may be added in one batch, multiple additions, or as a continuous flow. The use of a continuous flow is particularly applicable to continuous processes.

Preferably, R1, R2, R3, and R4 are independently selected from: H and Me. Most preferably, the manganese catalyst is derived from a ligand selected from the group consisting 1,4,7-Trimethyl-1,4,7-triazacyclononane ($Me_3$-TACN) and 1,2,-bis-(4,7,-dimethyl-1,4,7,-triazacyclonon-1-yl)-ethane ($Me_4$-DTNE).

The preformed transition metal catalyst salt is preferably a dinuclear Mn(III) or Mn(IV) complex with at least one $O^{2-}$ bridge.

pH Changing Materials

The pH of the aqueous environment of the cellulose material may be readily changed by the addition of acid or base. Suitable examples of acids are hydrochloric acid, sulphuric acid and acetic acid. Suitable examples of bases are sodium hydroxide, potassium hydroxide and sodium carbonate. The acid and basic components are preferably added as aqueous solutions, preferably dilute aqueous solutions.

Organic Sequestrant

Preferably, the aqueous solution comprises from 0.01 to 10 g/l of an organic sequestrant, the sequestrent selected from: an aminophosphonate sequestrent and a carboxylate sequestrent. This is particularly preferred for in the case where the cellulose material is cotton.

The sequestrant is either an aminophosphonate sequestrant or a carboxylate sequestrant. Preferably, the sequestrant is either an aminophosphonate sequestrant or an aminocarboxylate sequestrant.

The following are preferred examples of aminophosphonate sequestrants nitrilo trimethylene phosphonates, ethylene-diamine-N,N,N',N'-tetra(methylene phosphonates) (Dequest 204) and diethylene-triamine-N,N,N',N",N"-penta (methylenephosphonates) (Dequest 206), most preferably diethylene-triamine-N,N,N',N",N"-penta(methylenephosphonates. One skilled in the art will be aware that that different types of each Dequest exist, e.g., as phosphonic acid or as sodium salts or any mixture thereof.

The following are preferred examples of aminocarboxylate sequetrants: ethylenediaminetetraacetic acid (EDTA), N-hydroxyethylenediaminetetraacetic acid (HEDTA), nitrilotriacetic acid (NTA), N-hydroxyethylaminodiacetic acid, N-hydroxyethylaminodiacetic acid, glutamic diacetic acid, sodium iminodisuccinate, diethylenetriaminepentaacetic acid (DTPA), ethylenediamine-N,N'-disuccinic acid (EDDS), methylglycinediacetic acid (MGDA), and alanine-N,N-diacetic acid. A most preferred aminocarboxylate sequestrant is diethylenetriaminepentaacetic acid (DTPA).

The sequestrants may also be in the form of their salts, e.g., alkali metal, alkaline earth metal, ammonium, or substituted ammonium salts salts. Preferably the sequestrant is in the free acid form, sodium or magnesium salt.

Examples of carboxylate sequestrants are polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates. Polycarboxylates containing three carboxy groups include, in particular, water-soluble citrates, aconitrates and citraconates as well as succinate derivatives such as the carboxymethyloxysuccinates. Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1, 596,756. Examples of such salts are polyacrylates of M.Wt. 2000 to 5000 and their copolymers with maleic anhydride, such copolymers having a molecular weight of from 20,000 to 70,000, especially about 40,000.

Also copolymeric polycarboxylate polymers which, formally at least, are formed from an unsaturated polycarboxylic acid such as maleic acid, citraconic acid, itaconic acid and mesaconic acid as first monomer, and an unsaturated monocarboxylic acid such as acrylic acid or an alpha —C1-C4 alkyl acrylic acid as second monomer. Such polymers are available from BASF under the trade name Sokalan® CP5 (neutralised form), Sokalan® CP7, and Sokalan® CP45 (acidic form).

Most preferred sequestrants are Dequest 2066 or DTPA.

Surfactant

It is preferred that bleaching method is conducted in the presence of a surfactant. The use of surfactants, for example, helps to remove the waxy materials encountered in cotton. For substrates originating from wood pulp, hydrophobic substrates are not encountered and therefore, the need of surfactants in the treatment process is not so preferred. In this regard, it is preferred that a surfactant is present in the range from 0.1 to 20 g/L, preferably 0.5 to 10 g/l. It is preferred that the surfactant is a non-ionic surfactant and most preferably biodegradable.

EXPERIMENTAL

Experiment 1 pH Control by Continuously Adding NaOH Solution During the Bleaching Process Raw cotton with a Berger Whiteness value of 5.5+/−1.0 was treated as follows: 6 grams of the cotton was immersed into temperature-controlled beaker glasses a 60 ml solution (cloth/liquor ratio of 1/10) containing 20 microM of $[Mn_2O_3(Me_3\text{-}TACN)_2](PF_6)_2.H_2O$, 2.3% $H_2O_2$ (equals to 6.66 ml (35%)/l; w/w wrt cotton), 0.4 g/l H5-DTPA (ex Akzo-Nobel; trade name Dissolvine D50; purity is 50%), pH-value adjusted to desired level (after correction for temperature differences), 2 g/l Sandoclean PCJ (ex Clariant).

Drops of NaOH (1M) were added to maintain the pH (within 0.2 pH units) for 30 minutes of agitated solutions at 75 to 80° C. The pH was monitored with a pH meter. Subsequently the cotton swatches were rinsed with 2 to 3 liters of hot demineralised water (80° C.), then washed with copious amounts of demineralised water, spun in a spin drier for 3 minutes and dried overnight under ambient conditions. The optical properties of the cloths were then measured using a Minolta spectrophotometer CM-3700d, using L, a, b values which are converted to Berger Whiteness values.

The values of the whiteness is expressed in Berger units. The formula of Berger whiteness is given below:

$$W_{berger}=Y+a.Z-b.X, \text{ where } a=3.448 \text{ and } b=3.904.$$

The values X, Y, Z are the coordinates of the achromatic point.

The results of the experiments are given in Table 1

TABLE 1

Whiteness (Berger) results obtained using 20 microM $[Mn_2O_3(Me_3\text{-}TACN)_2](PF_6)_2 \bullet H_2O$ in an unbuffered solution with 0.2 g/l DTPA at 80° C. for 30 minutes.

| pH(init) | pH(final) | Wb | SD |
|---|---|---|---|
| 9.75 | 7.3 | 51.0 | 0.4 |
| 10.0 | 9.5 | 63.1 | 0.8 |

The results shown in the Table 1 indicate that when controlling the pH (entry 2), the bleach effect is much larger than when allowing the pH to drop below 8.0. As a benchmark, the bleach performance in the absence of the manganese catalyst shows 41.0 Wb (at pH 10) under these conditions. Without DTPA added, in the presence of catalyst the whiteness is about 10 Wb lower than the system with DTPA.

Experiment 2 pH Control by Pretreating the Cotton with NaOH/H2O2 without Catalyst and then Lowering the pH to an Optimal Level and Adding the Catalyst Raw cotton with a Berger Whiteness value of 5.5+/−1.0 was treated as follows: 6 grams of the cotton was immersed into temperature-controlled beaker glasses of a 60 ml solution (cloth/liquor ratio of 1/10), containing 0.5 g/l DTPA, 2 g/l Sandoclean PCJ, 2.3% $H_2O_2$ (equals to 6.66 ml (35%)/1; w/w wrt cotton), for 15 minutes at 75° C. Subsequently, sulphuric acid was added (1M) until the desired pH was added followed by 20 microM of $[Mn_2O_3(Me_3\text{-}TACN)_2](PF_6)_2.H_2O$ and the mixture left for 15 minutes with continuous stirring. No NaOH solution was added during the bleaching process in the presence of catalyst. After the allocated time, the cloths are washed and dried as exemplified above. The values of the whiteness are expressed in Berger units, as defined above.

The results are given in Table 2.

Table 2: Whiteness (Berger) results obtained using 20 microM $[Mn_2O_3(Me_3\text{-}TACN)_2](PF_6)_2.H_2O$ in an unbuffered solution with 0.2 g/l DTPA at 75° C. for 15 minutes, after having the cloths allowed to pretreat with $NaOH/H_2O_2$ for 15 minutes at 75° C. (entry 1) vs adding the catalyst at the beginning of the bleaching experiment at pH 9.75.

TABLE 2

| pH(step 1) | pH(step2) | pH(final) | Wb | SD |
|---|---|---|---|---|
| 11 | 10 | 9.4 | 60.0 | 0.0 |
| 9.75 | | 7.6 | 51.0 | 0.4 |

The results in Table 2 indicate that the pre-treatment step offers a big advantage in bleaching results, as compared to the comparative experiment wherein the catalyst is allowed to bleach the substrate starting from pH 10 without pre-treatment step (entry 2). As a comparative experiment, bleaching the cloths at pH 11 without catalyst, yielded a final pH of 9.9 and 51.0 (0.9 SD) Wb points.

Experiment 3

Starting at pH 10.9 and Letting the pH Reduce During the Bleaching Reaction

A batch of raw cotton with a Berger Whiteness value of 0 was treated as follows: 6 grams of the cotton was immersed into temperature-controlled beaker glasses a 60 ml solution (cloth/liquor ratio of 1/10) containing 10 microM of $[Mn_2O_3(Me_3\text{-}TACN)_2](PF_6)_2.H_2O$, 2.3% $H_2O_2$ (equals to 6.66 ml (35%)/l; w/w wrt cotton), 0.4 g/l H5-DTPA (ex Akzo-Nobel; trade name Dissolvine D50; purity is 50%), and 2 g/l Sandoclean PCJ (ex Clariant). The temperature of the experiment was 77° C.

The pH of water containing Sandoclean, Na5DTPA, cotton and appropriate amount of NaOH was determined at room temperature, heated to 77° C., the pH value was monitored and then hydrogen peroxide was added. Then a correction for the addition of hydrogen peroxide was made by adding some extra NaOH. Then the catalyst was added and left for 30 minutes under stirring. The cloths were then rinsed and washed as described above. The pH of the solution after the bleaching stage was determined after allowing the solution cooled down to room temperature. As a comparative experiment to determine the effect of the manganese-triazacyclononane compound, no catalyst was added. The results are given in the table below. The values of the whiteness are expressed in Berger units, as defined above.

| | pH(init) | pH(final) | Wb | SD |
|---|---|---|---|---|
| Without catalyst | 10.7 | 9.6 | 51.5 | 0.6 |
| With catalyst | 10.7 | 9.7 | 57.6 | 0.7 |

The results shown in the table indicate that at this pH the effect of the catalyst is significant, compared to the reference experiment.

We claim:

1. A method of bleaching a cellulose material comprising the following steps:

treating the cellulose material with an non-buffered aqueous solution having an initial pH from 8 to 11, the aqueous solution comprising:

(i) a preformed transition metal catalyst having a concentration from 0.1 to 100 micromolar, wherein the preformed transition metal catalyst is a mononuclear or dinuclear complex of a Mn(III) or Mn(IV) transition metal catalyst, and the ligand of the transition metal catalyst is of formula (I):

(I)

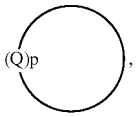

wherein: Q = 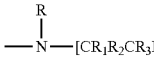 ;

p is 3;

R is independently selected from: hydrogen, C1-C6-alkyl, $CH_2CH_2OH$, and $CH_2COOH$, or one of R is linked to the N of another Q via an ethylene bridge;

R1, R2, R3, and R4 are independently selected from: H, C1-C4-alkyl, and C1-C4-alkylhydroxy, and (ii) from 5 to 1500 mM of hydrogen peroxide; and maintaining the pH of the aqueous solution within an operating window such that the initial pH does not decrease by more than 1.5 pH units during the treating step, wherein maintaining the pH comprises a process selected from the group consisting of:

(a) pretreating the cellulose material, wherein the cellulose material is treated with NaOH at a pH from 11 to 12 for between 2 and 120 min at a temperature in the range from 50 to 110° C. in the absence of the preformed transition metal catalyst; lowering the pH to the range from 9 to 11; and then adding the non-buffered aqueous solution to treat the cellulose material for between 2 and 60 min at 50 to 110° C.;

(b) adjusting the pH of the non-buffered aqueous solution in the presence of NaOH and an organic sequestrant selected from an aminophosphonate sequestrant or a carboxylate sequestrant to a pH in the range from 10 to 11; to treat the cellulose material; and (c) adding aqueous NaOH during the treating step to maintain the pH within the operating window.

2. A method according to claim 1, wherein R1, R2, R3, and R4 are independently selected from: H and Me.

3. A method according to claim 1, wherein the ligand is 1,4,7-Trimethyl-1,4,7-triazacyclononane ($Me_3$-TACN).

4. A method according to claim 1, wherein the preformed transition metal catalyst is a dinuclear Mn(III) or Mn(IV) complex with at least one $O^{2-}$ bridge.

5. A method according to claim 1, wherein the aqueous solution further comprises from 0.01 to 10 g/l of an organic sequestrant, selected from: an aminophosphonate sequestrant or a carboxylate sequestrant.

6. A method according to claim 5, wherein the carboxylate sequestrant comprises aminophosphonatc sequestrant.

7. A method according to claim 5, wherein the organic sequestrant is selected from the group consisting of: a diethylenetriamine-N,N,N',N",N"-penta(methylenephosphonate), diethylenetriamine-N,N,N',N",N"-penta(methylenephosphonic acid) and diethylenetriamine pentaacetic acid.

8. A method according to claim 1, wherein the aqueous solution comprises from 5 to 100 mM of the hydrogen peroxide.

9. A method according to claim 1, wherein the initial pH of the aqueous solution is between 9 and 10.5.

10. A method according to claim 1, wherein the cellulose material is cotton and process (a) is selected for maintaining the pH, and wherein process (a) further comprises adding hydrogen peroxide during the pretreating step.

11. A method according to claim 10, wherein during the process (a), the cellulose material is pretreated for between 5 and 40 minutes at 60 to 90° C.; and the cellulose material is treated with the non-buffered aqueous solution for between 5 and 40 min at 60 to 90° C.

12. A method according to claim 1, wherein process (c) is selected for maintaining the pH, and process (c) further comprises using a pH probe to monitor the pH of the cellulose material, the pH probe having a feed back loop controlling the addition of an acidic or a basic material to maintain the pH within the operating window.

13. A method according to claim 12, wherein the operating window is such that the pH does not decrease by more than 1 pH unit during the treating step.

14. A method of bleaching a cellulose material comprising the following steps:

treating the cellulose material with an non-buffered aqueous solution having an initial pH from 8 to 11, the aqueous solution comprising:

(i) a preformed transition metal catalyst having a concentration from 0.1 to 100 micromolar, wherein the preformed transition metal catalyst is a mononuclear or dinuclear complex of a Mn(III) or Mn(IV) transition metal catalyst, and the ligand of the transition metal catalyst is 1,2,-bis-(4,7,-dimethy-1,4,7,-triazacyclonon-1-yl)-ethane ($Me_4$-DTNE); and (ii) from 5 to 1500 mM of hydrogen peroxide; and maintaining the pH of the aqueous solution within an operating window such that the initial pH does not decrease by more than 1.5 pH units during the treating step, wherein maintaining the pH comprises a process selected from the group consisting of:

(a) pretreating the cellulose material, wherein the cellulose material is treated with NaOH at a pH from 11 to 12 for between 2 and 120 min at a temperature in the range from 50 to 110° C. in the absence of the preformed transition metal catalyst; lowering the pH to the range from 9 to 11; and then adding the non-buffered aqueous solution to treat the cellulose material for between 2 and 60 min at 50 to 110° C.;

(b) adjusting the pH of the non-buffered aqueous solution in the presence of NaOH and an organic sequestrant selected from an aminophosphonate sequestrant or a carboxylate sequestrant to a pH in the range from 10 to 11 to treat the cellulose material; and (c) adding aqueous NaOH during the treating step to maintain the pH within the operating window.

* * * * *

UNITED STATES PATENT AND TRADEMARK OFFICE

CERTIFICATE OF CORRECTION

PATENT NO. : 7,976,582 B2
APPLICATION NO. : 12/523057
DATED : July 12, 2011
INVENTOR(S) : Joaquim Manuel Henriques de Almeida et al.

It is certified that error appears in the above-identified patent and that said Letters Patent is hereby corrected as shown below:

In the Claims

In Column 10, Line 14, (Approx.), in Claim 1, change "11;" to --11--.

In Column 10, Line 26, in Claim 5, change "sequestrant," to --sequestrant--.

In Column 10, Line 29, in Claim 6, change "aminophosphonatc" to --aminocarboxylate--.

In Column 11, Line 1, in Claim 14, change "dimethy" to --dimethyl--.

Signed and Sealed this
Third Day of June, 2014

Michelle K. Lee

Michelle K. Lee
*Deputy Director of the United States Patent and Trademark Office*